US009884328B2

(12) United States Patent
Kozawa et al.

(10) Patent No.: US 9,884,328 B2
(45) Date of Patent: Feb. 6, 2018

(54) CYCLONE DEVICE AND CLASSIFICATION METHOD

(71) Applicant: NISSHIN SEIFUN GROUP INC., Tokyo (JP)

(72) Inventors: Kazumi Kozawa, Fujimino-shi (JP); Yusuke Igawa, Fujimino-shi (JP)

(73) Assignee: NISSHIN SEIFUN GROUP INC., Tokyo (JP)

( * ) Notice: Subject to any disclaimer, the term of this patent is extended or adjusted under 35 U.S.C. 154(b) by 0 days.

(21) Appl. No.: 15/322,499

(22) PCT Filed: Aug. 19, 2015

(86) PCT No.: PCT/JP2015/073179
§ 371 (c)(1),
(2) Date: Dec. 28, 2016

(87) PCT Pub. No.: WO2016/031636
PCT Pub. Date: Mar. 3, 2016

(65) Prior Publication Data

US 2017/0128957 A1 May 11, 2017

(30) Foreign Application Priority Data

Aug. 29, 2014 (JP) ..... 2014-175669

(51) Int. Cl.
*B04C 5/00* (2006.01)
*B04C 5/04* (2006.01)
(Continued)

(52) U.S. Cl.
CPC ..... *B04C 5/04* (2013.01); *B04C 5/185* (2013.01); *B04C 11/00* (2013.01); *B07B 7/086* (2013.01); *B07B 9/02* (2013.01)

(58) Field of Classification Search
CPC ..... B04C 5/04; B04C 5/185
(Continued)

(56) References Cited

U.S. PATENT DOCUMENTS 2,861,304 A * 11/1958 Wenninger ..... B22C 5/10 209/134
2,929,501 A * 3/1960 Fenske ..... B04C 5/00 209/716
(Continued)

FOREIGN PATENT DOCUMENTS

JP H08-52383 A 2/1996
JP H10-34022 A 2/1998
(Continued)

OTHER PUBLICATIONS

Feb. 28, 2017 International Preliminary Report on Patentability issued in International Patent Application No. PCT/JP2015/073179.
(Continued)

*Primary Examiner* — Terrell H Matthews
(74) *Attorney, Agent, or Firm* — Oliff PLC

(57) ABSTRACT

A cyclone main body includes a cylinder-shaped upper barrel and an inverse cone-shaped lower barrel; a top plate which covers a top edge of the upper barrel and includes an opening at a center portion; a first introduction pipe which introduces a first fluid containing powder along an inner wall surface of the cyclone main body; a second introduction pipe which is disposed near the top plate in a portion upper than the first introduction pipe and introduces a second fluid; an exhaust pipe which is inserted in the opening of the top plate along a vertical center axis of the cyclone main body, makes an exhaust flow rise from the cyclone main body, and discharges the exhaust flow from the cyclone main body; and a collecting section which collects powder separated by
(Continued)

turning movement of each of the first fluid and the second fluid in the cyclone main body.

8 Claims, 5 Drawing Sheets

(51) Int. Cl.
*B04C 5/185* (2006.01)
*B07B 7/086* (2006.01)
*B07B 9/02* (2006.01)
*B04C 11/00* (2006.01)

(58) Field of Classification Search
USPC ..... 209/133, 134, 716
See application file for complete search history.

(56) References Cited

U.S. PATENT DOCUMENTS 4,317,716 A * 3/1982 Liller ..... B03B 9/005 209/484
4,344,783 A * 8/1982 Heinemann ..... F28C 3/12 209/715
6,277,278 B1 * 8/2001 Conrad ..... B04C 3/00 209/715
7,900,779 B2 * 3/2011 Kolacz ..... B01D 45/14 209/133
8,899,163 B2 * 12/2014 Takeuchi ..... B02C 15/007 110/222
8,950,589 B2 * 2/2015 Mundheim ..... B01D 17/0217 209/716
2009/0032443 A1 2/2009 Taketomi et al.
2010/0270214 A1 10/2010 Taketomi et al.
2014/0021109 A1 1/2014 Kozawa et al.
2017/0128957 A1 * 5/2017 Kozawa ..... B04C 5/04

FOREIGN PATENT DOCUMENTS

JP 2001-224983 A 8/2001
JP 2006-102657 A 4/2006
JP 2009-034560 A 2/2009
JP 2009-108716 A 5/2009
JP 2013-007267 A 1/2013
WO 2012/066885 A1 5/2012

OTHER PUBLICATIONS

Nov. 10, 2015 International Search Report issued in International Patent Application No. PCT/JP2015/073179.

* cited by examiner

FIG. 5

| | EXISTENCE OR NON-EXISTENCE OF BENDING PORTION | INTRODUCTION AMOUNT OF COMPRESSED AIR | CYCLONE YIELD |
|---|---|---|---|
| (a) | NON-EXISTENCE (STRAIGHT PIPE) | 0 NL/min | 75.5 % |
| (b) | EXISTENCE (CURVED PIPE) | 0 NL/min | 76.3 % |
| (c) | NON-EXISTENCE (STRAIGHT PIPE) | 500 NL/min | 92.0 % |
| (d) | EXISTENCE (CURVED PIPE) | 500 NL/min | 92.5 % |

CYCLONE DEVICE AND CLASSIFICATION METHOD

TECHNICAL FIELD

The present invention relates to a cyclone device used for collecting powder and a classification method which classifies powder by using the cyclone device.

BACKGROUND ART

Conventionally, a cyclone type dust collecting device which separates and collects powder dust and the like in a fluid with a centrifugal force has been known (for example, Patent Literature 1). According to this cyclone type dust collecting device, a fluid to be subjected to dust removing is made to turn in a cyclone chamber, whereby powder contained in the fluid is separated from the fluid by a centrifugal force, and collected.

CITATION LIST

Patent Literature

Patent Literature 1: JP H08-52383 A

SUMMARY OF INVENTION

Technical Problem

However, in the above-mentioned cyclone type dust collecting device, there has been a problem that fine particles with particle diameters of about 0.1 μm to 2.0 μm cannot be separated from a fluid effectively and it is difficult to raise a collection efficiency of fine particles.

For this reason, in the case of collecting fine particles, a bag filter which can select a filter cloth so as to match a particle diameter to be collected, has been used in many cases.

An object of the present invention is to provide a cyclone device which can collect fine particles with a high collection efficiency and a classification method which classifies powder by using the cyclone device.

Solution to Problem

A cyclone device of the present invention includes: a cyclone main body which includes a cylinder-shaped upper barrel and an inverse cone-shaped lower barrel; a top plate which covers a top edge of the upper barrel and includes an opening at a center portion; a first introduction pipe which introduces a first fluid containing powder along an inner wall surface of the cyclone main body; a second introduction pipe which is disposed near the top plate in a portion upper than the first introduction pipe and introduces a second fluid; an exhaust pipe which is inserted in the opening of the top plate along a vertical center axis of the cyclone main body, makes an exhaust flow rise from the cyclone main body, and discharges the exhaust flow from the cyclone main body; and a collecting section which collects powder separated by turning movement of each of the first fluid and the second fluid in the cyclone main body.

In the cyclone device of the present invention, the second fluid is introduced in a direction along a direction orthogonal to the vertical center axis of the cyclone main body and in a direction parallel to a tangential line on an inner wall surface of the upper barrel.

In the cyclone device of the present invention, the first introduction pipe includes a bending portion which bends with a predetermined curvature.

In the cyclone device of the present invention, a plurality of the second introduction pipes are disposed.

In the cyclone device of the present invention, the second fluid introduced from the second introduction pipe is introduced at a speed faster than that of the first fluid introduced from the first introduction pipe.

In the cyclone device of the present invention, air is used as the first fluid, and compressed air is used as the second fluid.

A classification method of the present invention which classifies powder by using the cyclone device of the present invention, includes adjusting a pressure of the second fluid.

A classification method of the present invention which classifies powder by using the cyclone device of the present invention, includes adjusting a flow amount of the second fluid.

A classification method of the present invention which classifies powder by using the cyclone device of the present invention, includes adjusting a pressure loss of the cyclone device.

Advantageous Effects of Invention

According to the cyclone device of the present invention and the classification method which classifies powder by using the cyclone device, fine particles can be collected with a high collection efficiency.

BRIEF DESCRIPTION OF DRAWINGS

FIG. 5 is a diagram showing a relationship between an existence or non-existence of bending of a first introduction pipe in the cyclone device according to the embodiment and a cyclone yield.

DESCRIPTION OF EMBODIMENTS

Figure 1:
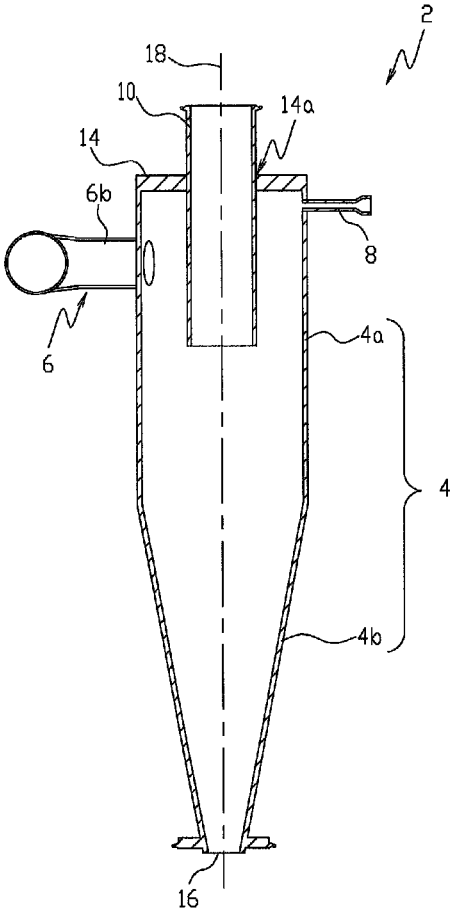
FIG. 1 is a view in which an internal structure of a cyclone device according to an embodiment is viewed from its side.
Figure 2:
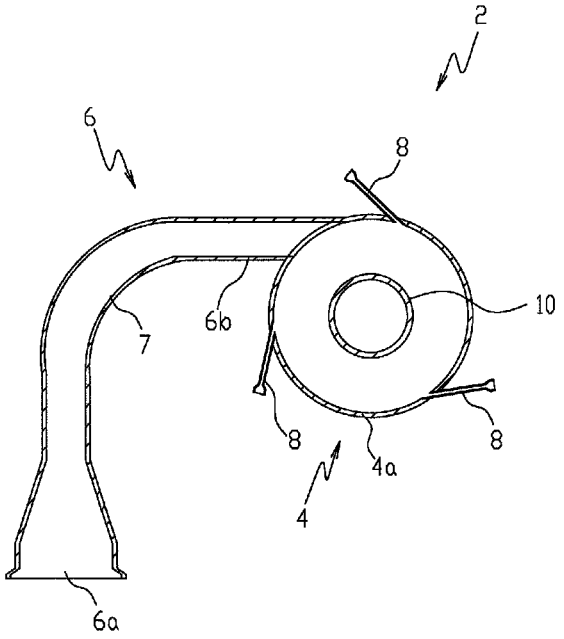
FIG. 2 is a view in which the internal structure of the cyclone device according to the embodiment is viewed from its upper portion.

Hereinafter, a cyclone device according to an embodiment of the present invention is described with reference to the drawings. FIG. 1 is a view in which the internal structure of the cyclone device is viewed from its side, and FIG. 2 is a view in which the internal structure of the cyclone device is viewed from its upper portion. As shown in FIGS. 1 and 2, the cyclone device 2 is equipped with a cyclone main body 4, a first introduction pipe 6, a second introduction pipe 8, an exhaust pipe 10, and a collecting section 12 (refer to FIG. 3).

Herein, the cyclone main body 4 is equipped with a cylinder-shaped upper barrel portion 4*a* and an inverse cone-shaped lower barrel portion 4*b* which is airtightly combined integrally with the upper barrel portion 4*a* at the lower end of the upper barrel portion 4*a*. The top portion of the upper barrel portion 4*a* is airtightly covered with a disc-shaped top plate 14 which has an opening portion 14*a* at its center, and at the lower end of the lower barrel portion 4*b*, an opening portion 16 is formed so as to discharge powder collected by the collecting section 12. Herein, "airtight" means a state of being sealed such that gas does not flow in from the outside and gas does not leak from the inside.

The first introduction pipe 6 is an L-shaped curved pipe equipped with a bending portion 7 which has a predetermined curvature, and has one end equipped with an introduction port 6*a* through which a first fluid containing powder is introduced, and the other end equipped with a connection portion 6*b* to be connected to the side wall of the upper barrel portion 4*a*. Here, a case where the bending portion 7 is bended by 90 degrees is described as an example. However, the bending should not be limited to 90 degrees.

Furthermore, the first introduction pipe 6 is located in a flat surface orthogonal to the vertical center axis 18 of the cyclone main body 4, and is arranged so as to be able to introduce the first fluid in a direction parallel to a tangential line on the inner wall surface of the upper barrel portion 4*a*. The sectional shape of the first introduction pipe 6 may be a rectangular shape, or may be a circular shape.

With regard to the second introduction pipe 8, in this example, three second introduction pipes 8 are arranged at a portion upper than the first introduction pipe 6, and are airtightly connected separately with an equal interval to the upper barrel portion 4*a* in the vicinity of the top plate 14. However, at least one second introduction pipe 8 may be arranged, and in the case where two or more second introduction pipes 8 are separately arranged, the arrangement interval may not be necessarily an equal interval. Furthermore, the second introduction pipe 8 is located in a flat surface orthogonal to the vertical center axis of the cyclone main body 4, and is arranged to be able to introduce compressed air in a direction parallel to a tangential line on the inner wall surface of the upper barrel portion 4*a* and in a direction orthogonal to the vertical center axis 18 of the cyclone main body 4, that is, in a horizontal direction.

The second introduction pipe 8 may be arranged so as to be able to introduce compressed air in a direction along a tangential line on the inner wall surface of the upper barrel portion 4*a* and in a direction along a direction orthogonal to the vertical center axis 18. Namely, the second introduction pipe 8 and a third introduction pipe 9 may be arranged so as to be able to introduce compressed air within a range capable of attaining the effect of the present invention without being limited to a direction perfectly coincident with a direction parallel to a tangential line on the inner wall surface of the upper barrel portion 4*a* and a direction perfectly coincident with a direction orthogonal to the vertical center axis 18.

The exhaust pipe 10 is inserted in the opening portion 14*a* of the top plate 14 along the vertical center axis 18, and is arranged such that its lower end portion is located at a predetermined position of the upper barrel portion 4*a*.

Figure 3:
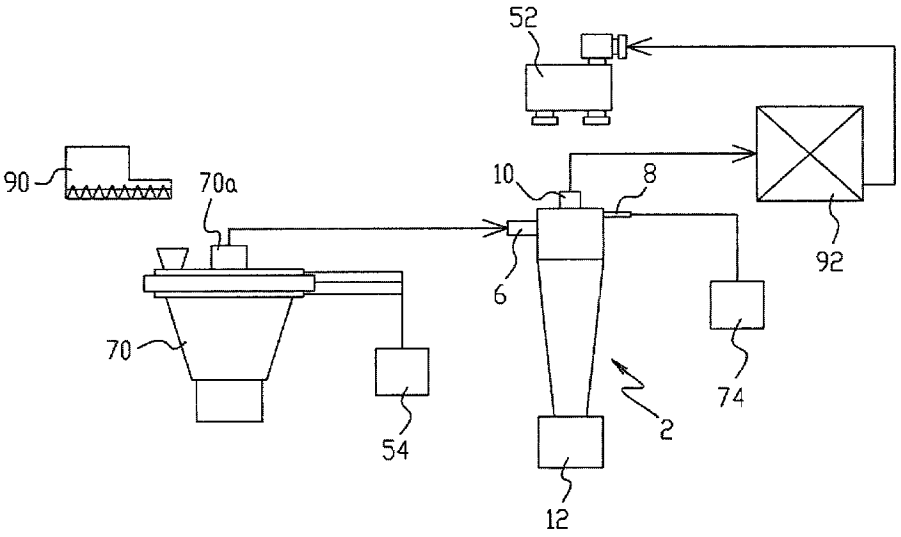
FIG. 3 is a schematic illustration showing a cyclone system according to the embodiment.

Next, treatment to collect powder by using the cyclone device 2 is described with reference to a schematic diagram of a cyclone system shown in FIG. 3. Herein, a case where an experiment is performed by using silica powder as raw material powder is described as an example. Furthermore, the experiment is performed in such a way that an introduction amount of compressed air introduced into the cyclone device 2 is changed to 0 (NL/min), 170 (NL/min), 350 (NL/min), and 500 (NL/min).

First, when an operation of the cyclone system is started, a blower 52, a compressor 54, and a compressor 74 are driven, respectively.

Herein, when the blower 52 is driven, gas in the cyclone main body 4 is sucked through the exhaust pipe 10. With this suction, a spiral rotational flow occurs along the inner wall surface of the cyclone main body 4.

Furthermore, when the compressor 54 is driven, compressed air is sent into a classifier 70. With this, a rotational flow occurs along an inner wall surface in the classifier 70, whereby it becomes possible to classify raw material powder introduced into the classifier 70.

Furthermore, when the compressor 74 is driven, compressed air is introduced from the three second introduction pipes 8 in a direction parallel to a tangential line on the inner wall surface of the cyclone main body 4 and in a horizontal direction. The speed of the compressed air introduced in the cyclone main body 4 is a speed faster than the speed of the first fluid introduced from the first introduction pipe 6. With this, the rotational speed of the rotational flow in the cyclone main body 4 is accelerated.

Next, silica powder that is the raw material powder is supplied to the classifier 70 by a feeder 90. Here, the median diameter $D_{50}$ of the silica powder supplied to the classifier 70 is 1.1 μm, and the silica powder is supplied by a supply amount of 1 kg/h.

The silica powder classified in the classifier 70 is discharged from a discharging pipe 70*a*, and the first fluid containing the silica powder in air is introduced into the first introduction pipe 6 from the introduction port 6*a* shown in FIG. 2. Here, the median diameter $D_{50}$ of the silica powder contained in the first fluid is 0.55 μm, and the first fluid is introduced into the first introduction pipe 6 with an introduction amount of 400 g/h.

The first fluid introduced into the first introduction pipe 6 goes straight in the first introduction pipe 6, and thereafter, passes the bending portion 7. Here, since a centrifugal force acts on the powder contained in the first fluid, the powder is unevenly distributed on the outer periphery side of the bending portion 7. The first fluid having passed the bending portion 7 goes straight in the first introduction pipe 6 in a state where the powder has been unevenly distributed at a position separated away from the vertical center axis 18 of the cyclone main body 4, and thereafter, the first fluid is introduced in the cyclone main body 4 along an inner wall surface of the cyclone main body 4 in a direction parallel to a tangential line on the inner wall surface and in a horizontal direction.

Next, the powder introduced in the cyclone main body 4 with the first fluid rides on a rotational flow formed at a portion upper than the first introduction pipe 6 by the second introduction pipe 8, and goes down while turning in the inside of the cyclone main body 4. Since the powder in the rotational flow is separated from the rotational flow by the centrifugal force of the turning movement, an amount of the powder discharged from the exhaust pipe 10 is reduced. In the cyclone device 2, fine particles with a particle diameter of about 0.1 μm to 2.0 μm are separated effectively.

A part of the powder separated from the rotational flow adheres as aggregate to the inner wall surface of the cyclone main body 4, and the powder having not adhered to the inner wall surface is collected by the collecting section 12, and thereafter, is recovered. The powder having adhered to the inner wall surface is collected by dismantling the cyclone main body 4.

The particles having been not separated from the rotational flow goes up from the inside of the cyclone main body 4 together with an exhaust gas flow, is discharged from the exhaust pipe 10, and thereafter, is collected by a bag filter 92.

Figure 4:
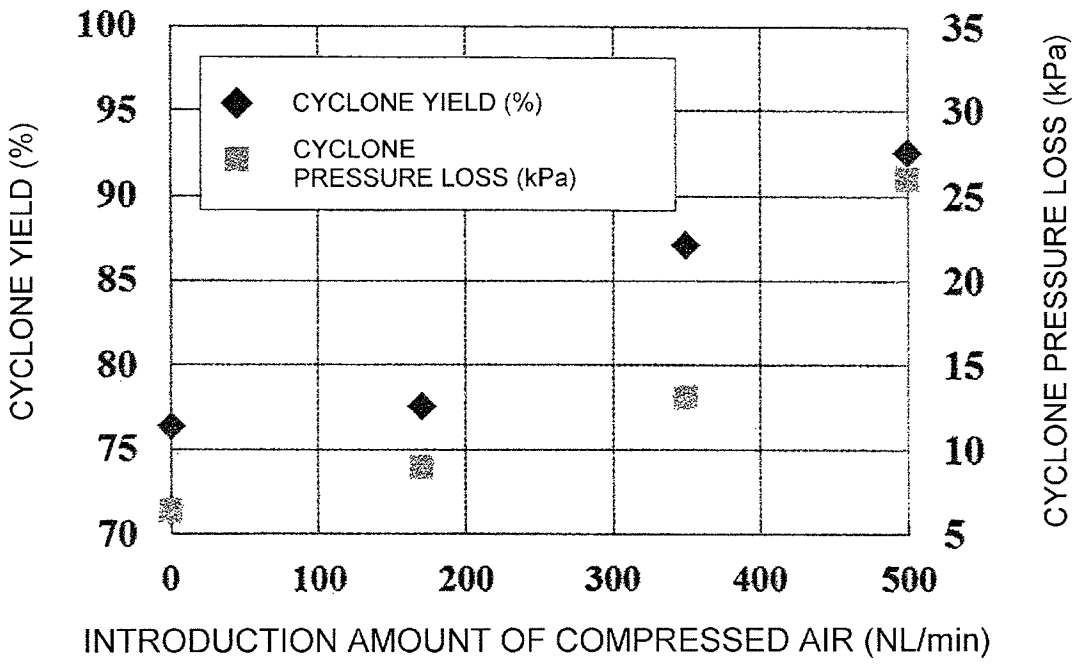
FIG. 4 is a diagram showing a relationship between an introduction amount of compressed air introduced into the cyclone device according to the embodiment and a cyclone yield.

FIG. 4 is a diagram showing a relationship between an introduction amount of compressed air introduced into the cyclone device 2 and a cyclone yield (a weight of powder collected from the collecting section 12 and the inside of the cyclone main body 4/a weight of powder contained in the first fluid introduced in the cyclone main body 4). Here, in FIG. 4, a transverse axis shows an introduction amount of compressed air (NL/min), a left longitudinal axis show a cyclone yield (%), and a right longitudinal axis shows a cyclone pressure loss (kPa), respectively. FIG. 4 shows a result in the case where an introduction amount of the first fluid introduced from the first introduction pipe 6 into the inside of the cyclone main body 4 is 0.9 ($Nm^3$/min).

According to the experimental result shown in FIG. 4, in the case where an introduction amount of compressed air is 0 (NL/min) (namely, in the case where compressed air is not introduced from the second introduction pipe 8), a cyclone yield is 76.3%.

In contrast, in the case where an introduction amount of compressed air is increased to 170 (NL/min), a cyclone yield rises to 77.8%. Furthermore, in the case where an introduction amount of compressed air is increased to 350 (NL/min), a cyclone yield rises to 87.1%, and in the case where an introduction amount of compressed air is increased to 500 (NL/min), a cyclone yield rises to 92.5%.

That is, according to this experimental result, it is shown that a cyclone yield rises by introducing compressed air. Furthermore, according to this experimental result, in the case where an introduction amount of compressed air is increased, a pressure loss also rises.

In the cyclone device 2 according to this embodiment, since the second introduction pipe 8 is disposed at a portion upper than the first introduction pipe 6, powder introduced with the first fluid can be adequately made to ride in an accelerated rotational flow. Therefore, fine particles can be collected with high collection efficiency, and can be recovered with a high cyclone yield.

Furthermore, in the cyclone device 2 according to this embodiment, compressed air is introduced from a plurality of second introduction pipes 8 in a direction parallel to a tangential line on the inner wall surface of the cyclone main body 4 and in a horizontal direction. As a result, since the swing speed of a rotational flow in the cyclone main body 4 is accelerated effectively and the centrifugal force of the rotational flow is increased, powder contained in the first fluid can be recovered with a high cyclone yield.

Furthermore, in the cyclone device 2 according to this embodiment, in the case where the collecting section 12 is provided with a function to discharge collected powder to the outside of a system, since it is not necessary to stop operation of the cyclone system for each time when collected powder is recovered, the cyclone system can be operated continuously. In addition, since impurities, such as fiber of the bag filter 92, do not mix, fine particles with high purity can be collected.

FIG. 5 is a diagram showing a relationship between a cyclone yield and an existence or non-existence of the bending portion 7 in the first introduction pipe 6. Here, in the description of FIG. 5, a first introduction pipe not having the bending portion 7 is written as a non-existence (a straight pipe), and the first introduction pipe 6 having the bending portion 7 according to the present embodiment is written as an existence (a curved pipe). FIG. 5 shows a result in the case where each of an introduction amounts of the first fluid introduced into the inside of the cyclone main body 4 from a straight pipe and an introduction amount of the first fluid introduced into the inside of the cyclone main body 4 from a curved pipe is 0.9 ($Nm^3$/min).

In FIG. 5, an item (a) shows a cyclone yield in the case of connecting a straight pipe to the cyclone device 2 and introducing the first fluid from the straight pipe into the cyclone main body 4 in a state where compressed air is not introduced from the second introduction pipe 8.

Furthermore, an item (b) shows a cyclone yield in the case of introducing the first fluid from the curved pipe into the cyclone main body 4.

Furthermore, an item (c) shows a cyclone yield in the case of connecting the straight pipe to the cyclone device 2 and introducing the first fluid from the straight pipe into the inside of the cyclone main body 4 in a state where compressed air in an introduction amount of 500 (NL/min) is introduced from the second introduction pipe 8 into the inside of the cyclone main body 4.

Furthermore, an item (d) shows a cyclone yield in the case of introducing the first fluid from the curved pipe into the cyclone main body 4 in a state where compressed air in an introduction amount of 500 (NL/min) is introduced from the second introduction pipe 8 into the inside of the cyclone main body 4.

According to FIG. 5, as a cyclone yield in the case of not introducing compressed air from the second introduction pipe 8, the cyclone yield in the case of using the curved pipe is higher than that in the case of using the straight pipe.

Furthermore, as a cyclone yield in the case of introducing compressed air in an introduction amount of 500 (NL/min) from the second introduction pipe 8 into the inside of the cyclone main body 4, the cyclone yield in the case of using the curved pipe is higher than that in the case of using the straight pipe.

That is, in the cyclone device 2 according to the present embodiment, by introducing powder into the inside of the cyclone main body 4 in a state where the powder has been unevenly distributed at a position separated away from the vertical center axis 18 of the cyclone main body 4 by using the curved pipe, a cyclone yield can be increased as compared with a case of using the straight pipe.

Furthermore, in a classification method which classifies powder by using the cyclone device 2 according to this embodiment, by adjusting an introduction amount of compressed air introduced from the second introduction pipe 8, a desired classification diameter can be obtained, and a size of particles collected by using the cyclone device 2 can be controlled.

Furthermore, in a classification method which classifies powder by using the cyclone device 2 according to this embodiment, by adjusting a pressure of compressed air introduced from the second introduction pipe 8, a desired classification diameter can be obtained, and a size of particles collected by using the cyclone device 2 can be controlled.

Furthermore, in a classification method which classifies powder by using the cyclone device 2 according to this embodiment, by adjusting a cyclone pressure loss of the cyclone device 2, a desired classification diameter can be obtained, and a size of particles collected by using the cyclone device 2 can be controlled.

In the above-mentioned embodiment, the case where the median diameter $D_{50}$ of powder introduced with the first fluid is 0.55 μm is exemplified. However, the cyclone device 2 according to the present embodiment is suitable for collecting fine particles with a particle diameter of about 0.1 μm to 2.0 μm.

Furthermore, in the above-mentioned embodiment, the first introduction pipe 6 may not be necessarily be arranged such that the first fluid can be introduced in a direction parallel to a tangential line on the inner wall surface of the upper barrel portion 4*a*.

Furthermore, in the above-mentioned embodiment, in place of the silica powder, other metal powder, inorganic powder, organic powder, or the like may be used as the raw material powder.

The invention claimed is:

1. A cyclone device comprising:

a cyclone main body which includes a cylinder-shaped upper barrel and an inverse cone-shaped lower barrel;

a top plate which covers a top edge of the upper barrel and includes an opening at a center portion;

a first introduction pipe which introduces a first fluid containing powder along an inner wall surface of the cyclone main body;

a plurality of second introduction pipes which are located in a plane orthogonal to the vertical center axis of the cyclone main body and are disposed near the top plate in a portion closer to the top plate than the first introduction pipe and introduce a second fluid;

an exhaust pipe which is inserted in the opening of the top plate along a vertical center axis of the cyclone main body, makes an exhaust flow rise from the cyclone main body, and discharges the exhaust flow from the cyclone main body; and a collecting section which collects powder separated by turning movement of each of the first fluid and the second fluid in the cyclone main body.

2. The cyclone device described in claim 1, wherein the second fluid is introduced in a direction along a direction orthogonal to the vertical center axis of the cyclone main body and in a direction parallel to a tangential line on an inner wall surface of the upper barrel.

3. The cyclone device described in claim 1, wherein the first introduction pipe includes a bending portion which bends with a predetermined curvature.

4. The cyclone device described in claim 1, wherein the second fluid introduced from the plurality of second introduction pipes is introduced at a speed faster than that of the first fluid introduced from the first introduction pipe.

5. The cyclone device described in claim 1, wherein air is used as the first fluid, and compressed air is used as the second fluid.

6. A classification method which classifies powder by using the cyclone device described in claim 1, comprising adjusting a pressure of the second fluid.

7. A classification method which classifies powder by using the cyclone device described in claim 1, comprising adjusting a flow amount of the second fluid.

8. A classification method which classifies powder by using the cyclone device described in claim 1, comprising adjusting a pressure loss of the cyclone device.

* * * * *